US007762003B2

(12) United States Patent
Waltman, Jr.

(10) Patent No.: US 7,762,003 B2
(45) Date of Patent: Jul. 27, 2010

(54) SIDEWINDER LITE CUT

(75) Inventor: John Waltman, Jr., P.O. Box 8053, Gaffney, SC (US) 29340

(73) Assignee: John Waltman, Jr., Gaffney, SC (US)

( * ) Notice: Subject to any disclaimer, the term of this patent is extended or adjusted under 35 U.S.C. 154(b) by 0 days.

(21) Appl. No.: 12/110,234

(22) Filed: Apr. 25, 2008

(65) Prior Publication Data

US 2009/0266216 A1 Oct. 29, 2009

Related U.S. Application Data

(60) Provisional application No. 60/914,256, filed on Apr. 26, 2007.

(51) Int. Cl.
*B43L 7/10* (2006.01)

(52) U.S. Cl. ..... 33/202; 33/465

(58) Field of Classification Search ..... 33/202, 33/452, 455, 456, 463, 465, 478, 640
See application file for complete search history.

(56) References Cited

U.S. PATENT DOCUMENTS

| | | | | |
|---|---|---|---|---|
| 453,890 | A * | 6/1891 | Oerlein | 33/465 |
| 1,064,311 | A * | 6/1913 | Fox | 33/463 |
| 1,209,855 | A * | 12/1916 | La Follette | 33/463 |
| 1,640,604 | A * | 8/1927 | Hauber | 33/463 |
| 4,916,822 | A * | 4/1990 | Johnson | 33/465 |
| 5,414,938 | A * | 5/1995 | Meek | 33/452 |
| 6,105,267 | A * | 8/2000 | Hathaway | 33/465 |
| 6,330,752 | B1 * | 12/2001 | Ellam | 33/465 |
| 6,708,422 | B1 * | 3/2004 | Stojanovski | 33/640 |
| 6,766,586 | B2 * | 7/2004 | Brooks | 33/640 |
| 7,204,031 | B2 * | 4/2007 | Hanson | 33/478 |
| 2007/0227022 | A1 * | 10/2007 | Bruce | 33/455 |
| 2007/0277389 | A1 * | 12/2007 | Baida | 33/640 |

* cited by examiner

*Primary Examiner*—G. Bradley Bennett

(57) ABSTRACT

The invention is directed to a guide for a power saw or router of the type having a blade and housing wider than the blade which directly overlies the blade during the cutting operation. The guide includes a saw guide having a straight outer edge configured for guiding a peripheral edge of the saw housing. Attached to the saw guide is an angle brace that is used to place the guide at four different angles. Attached by bolt to the saw guide is the work piece guide that is placed against the object you are cutting so that you cut a straight angle every time.

1 Claim, 8 Drawing Sheets

Sidewinder

Sidewinder

Sidewinder
Saw Guide

Material: 1.5"x1.5", 1/8" thick

Sidewinder
Work Piece Guide

Tap hole 8-32 typical 3 places
Material: 1.5"x1.5", 1/8" thick

Sidewinder
Angle Brace

Ream 0.1875 typical 5 places

Material: 1"x1", 1/8" thick

Sidewinder

90º Position

Sidewinder

45º Position

Sidewinder 22.5º Position

Sidewinder 11.25º Position

SIDEWINDER LITE CUT

This application claims priority 2 Provisional application No. 60914256, filed Apr. 26, 2007.

TECHNICAL FIELD

A cutting tool used as a guide that allows a straight or angular cut across a piece of material. The guide will control the yaw axis of the tool used to make the cut before the cutting portion of the tool even touches the work piece.

BACKGROUND

Carpenters, do-it-yourself persons and others often find it necessary to cross cut a straight line or an angular cut on wood or various other materials quickly and accurately. Other methods have been used to perform this operation such as a Carpenter's/Framing square and many other devices, however, these devices when used with power tools present extremely dangerous if not fatal, risk's to the user.

A Carpenter's/Framing square was required to measure and mark the cut, thus requiring two operations to make a 90° cut in the work piece. Prior guides required clamping the guide to the work piece to prevent the guide from slipping. This requires a great deal of wasted time. Other guides although similar could make straight or angular cuts but could not be reliably locked at different angles thus causing inaccurate cuts and a great financial loss in expensive materials.

Taking the above factors into consideration it is easy to see that a guide which is safe, dependable and accurate is needed. The guide should allow the user to make a cut without the use of things like a Carpenters/Framing square. The guide should be able to make the majority of cuts without the use of a clamp. The guide should be able to be securely locked at different angles in order to make an accurate cut.

Another guide for a circular saw is disclosed in U.S. Pat. No. 5,472,029 to Ketch, issued Dec. 5, 1995 comprises a guide bar having a straight outer edge configured for guiding a peripheral guide surface of the saw housing, a gauge bar having a straight outer edge, and a hinge pivotally connecting the gauge bar to the guide bar. The gauge bar of this device is effective but large, making the device more expensive to fabricate. Saw guides are disclosed in U.S. Pat. No. 4,054,077, issued Oct. 18, 1977, entitled "Guide For Hand Held Power Saws," U.S. Pat. No. 2,926,706, issued on Mar. 1, 1960, entitled "Cross-Cut and Rip Guide Device for Portable Power Saws," and U.S. Pat. No. 5,271,159, issued on Dec. 21, 1993, entitled "Circular Saw Guide," These devices require the guide to be aligned in a spaced relation to the contemplated cut to allow for the distance between the saw and the edge of the flange on the saw.

SUMMARY OF THE INVENTION

The first and foremost feature of the tool is safety. The tool is constructed of 2 pieces of 90° angle material one of which is the saw guide with 5 holes. 2 of the holes one at each end of the saw guide are provided to hang the tool on a users tool belt. 2 threaded holes for attaching the saw guide to the work piece guide with a knurled edge shoulder bolt. 1 center hole that the angle brace, which will contain the holes for a 90°, 45°, 22.5° and an 11.25° hole. The saw guide keeps the persons hand at a safe distance from the cutting tool with the vertical side of the saw guide between the person's hand and the cutting tool. The angle brace which will be pop riveted to the center hole on the saw guide and bolted with a knurled edge shoulder bolt to the work piece guide will determine the angel of the cut and can be used to steady the guide while cutting.

By changing one bolt from one end of the saw guide to the other end, the tool may be used by either left or right handed persons.

The tool when put in the alignment hole for the 11.25° angle is small lightweight and can be carried on a person's tool belt or easily hung on a nail or pegboard hook in a workshop.

When making long cuts an available (optional saw guide) would be used and clamped in place at the end away from the operator on 4'×8' Sheets of material.

The tool's saw guide which extends approximately 3 to 4 inches over the rear horizontal surface of the work piece guide will allow a person with a cutting tool to align the tool with the saw before the actual cutter touches the material. Thus controlling the yaw axis of the tool which is the factor that causes bad cuts in the first place.

If the tool tilts, such as a circular or reciprocation type saw, compound miter cuts may be also be made. The tool can also reliably be used as a carpenter's square for marking cuts at different angles.

DESCRIPTION OF THE PREFERRED EMBODIMENT

Figure 1:
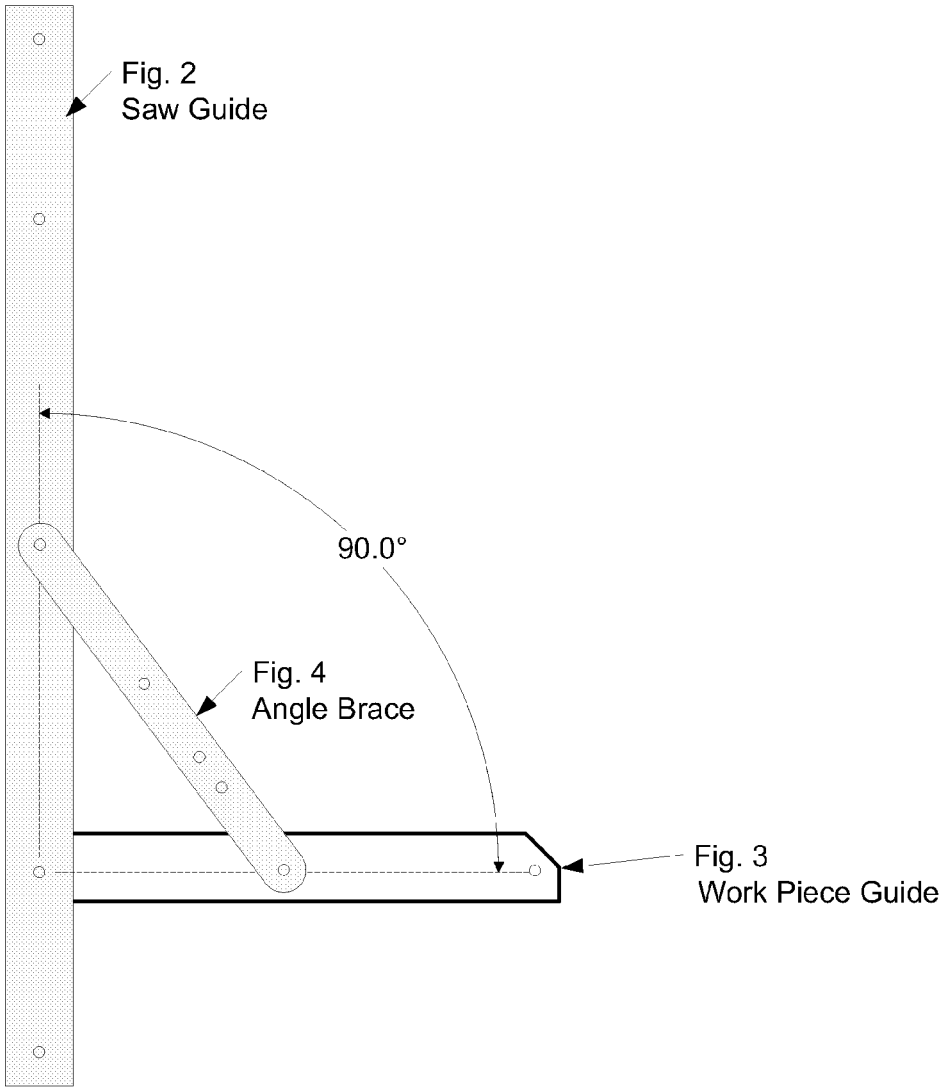
FIG. 1, Page 1 of 8 is a view of the entire tool.
Figure 2:
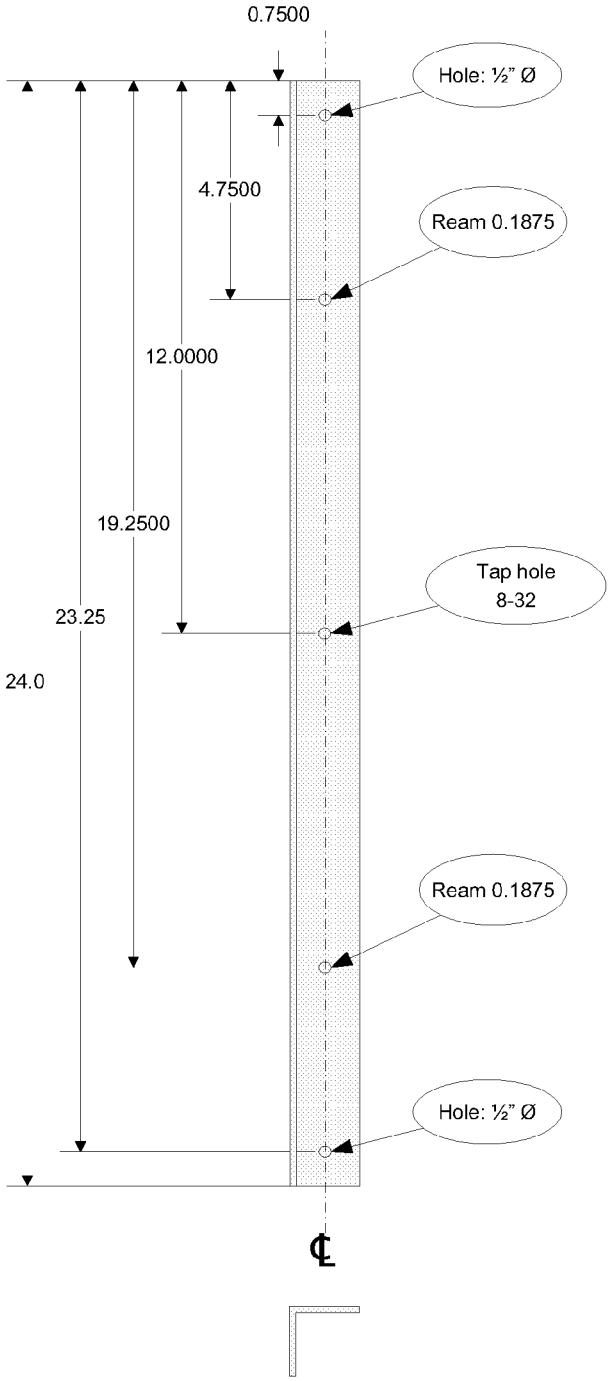
FIG. 2, Page 2 of 8 is a view of the Saw Guide.
Figure 3:
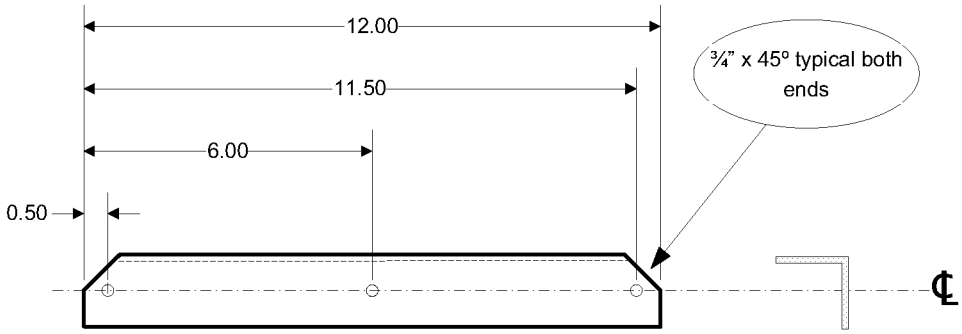
FIG. 3, Page 3 of 8 is a view of the Work Piece Guide.

Looking at FIG. 3 the Work Piece Guide corners are trimmed off so that when the Saw Guide FIG. 2 is moved to the various angels none of the Work Piece Guide, FIG. 3 protrudes.

Figure 4:
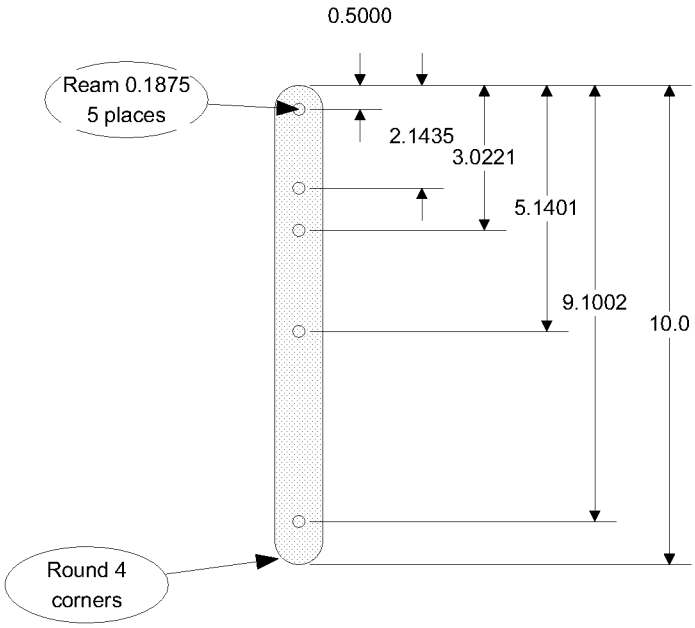
FIG. 4, Page 4 of 8 is a view of the Angle Brace.
Figure 5:
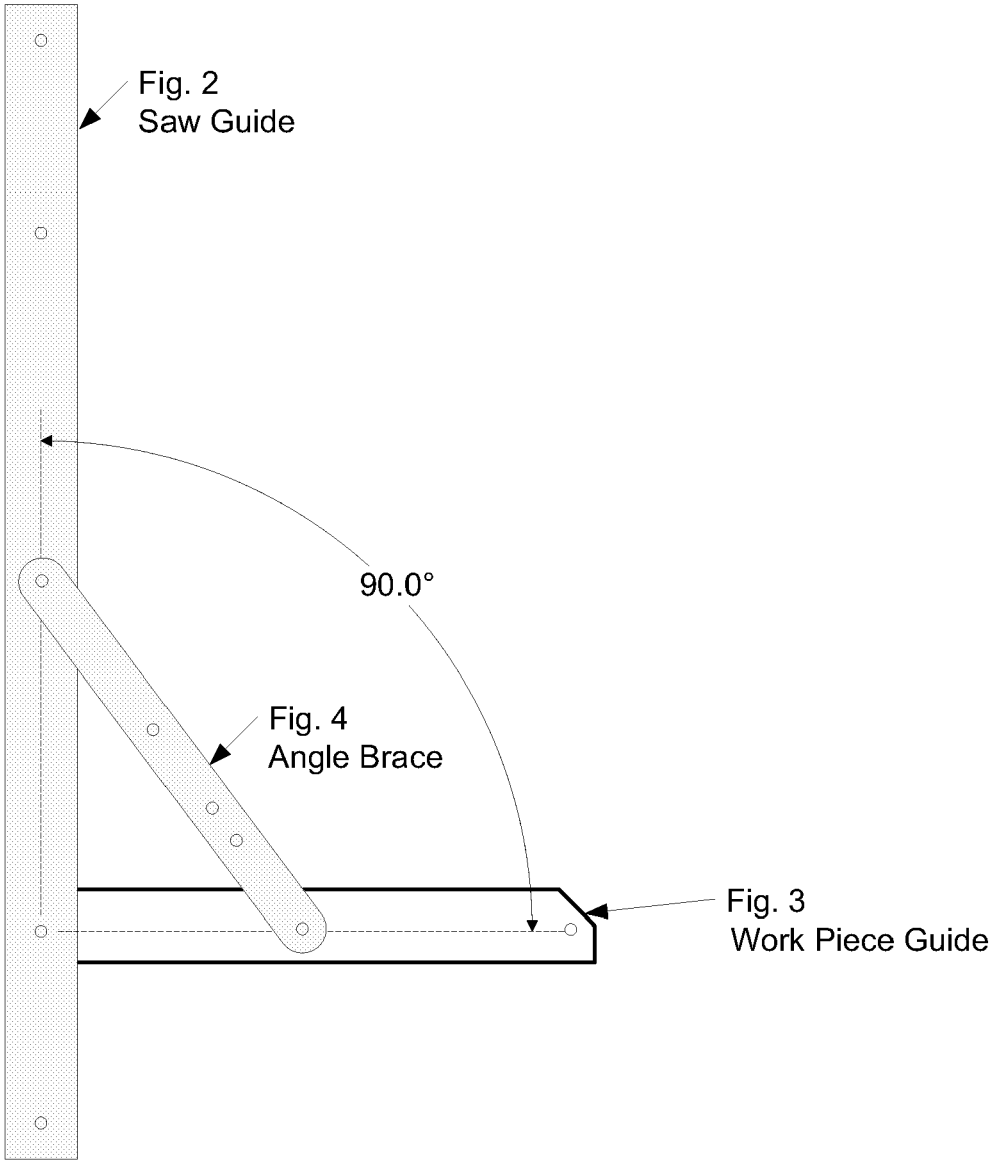
FIG. 5, Page 5 of 8 is a view of the Sidewinder locked in the 90° Angle.
Figure 6:
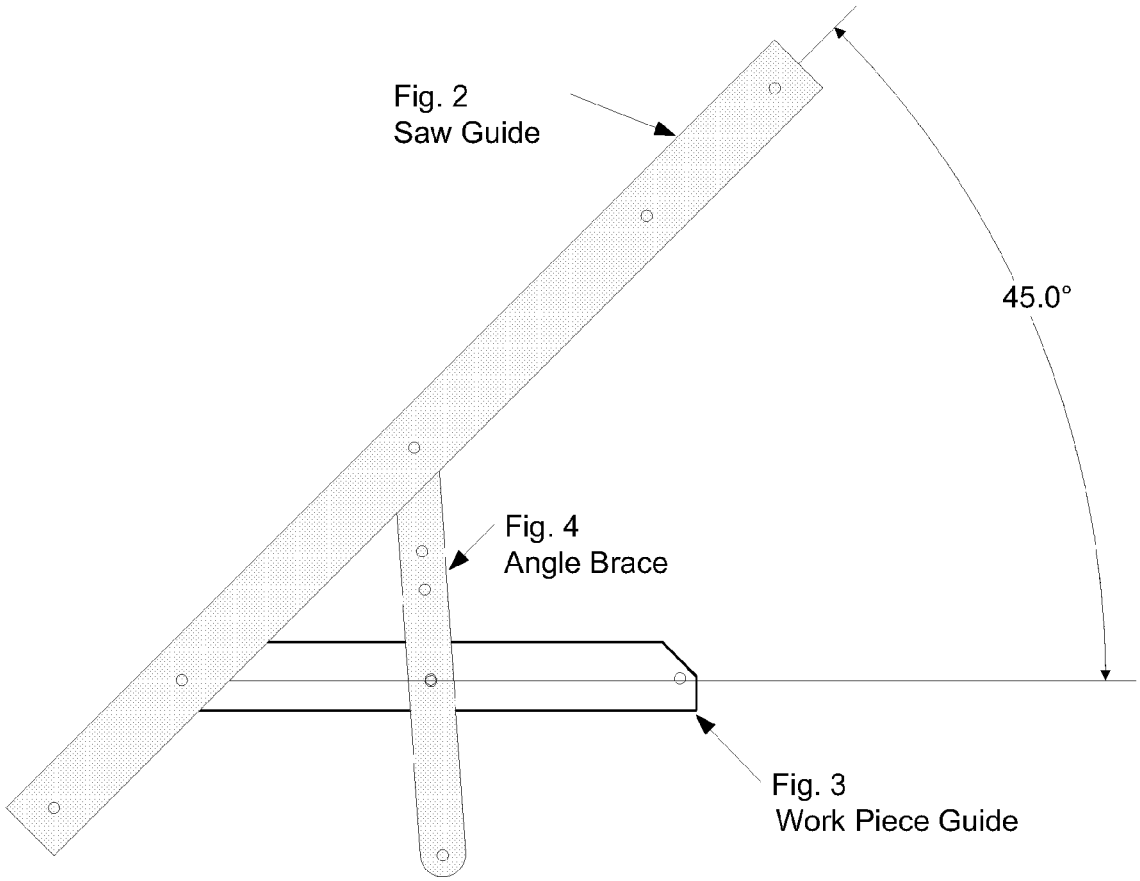
FIG. 6, Page 6 of 8 is a view of the Sidewinder locked in the 45° Angle.
Figure 7:
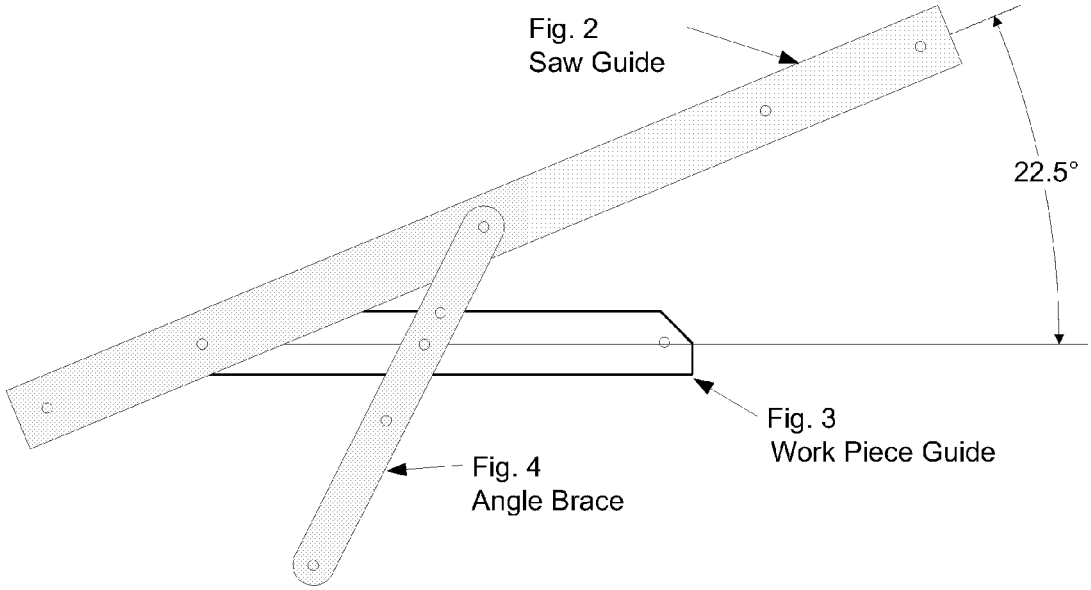
FIG. 7, Page 7 of 8 is a view of the Sidewinder locked in the 22.5° Angle.
Figure 8:
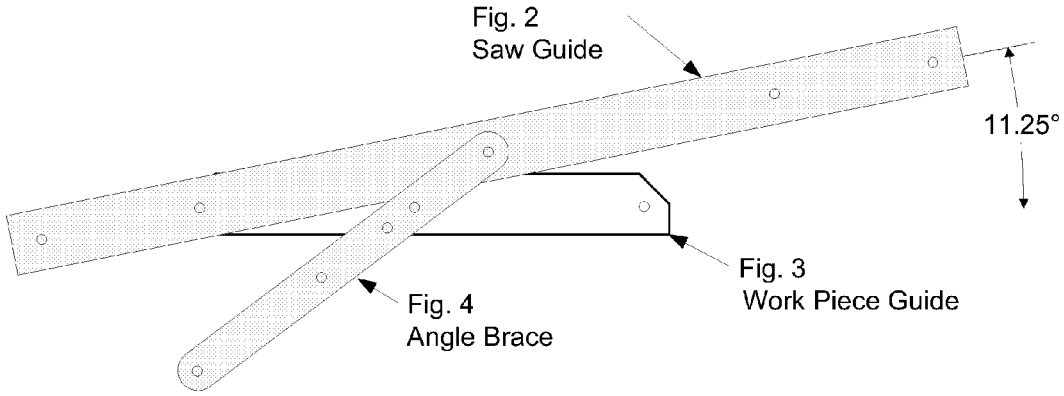
FIG. 8, Page 8 of 8 is a view of the Sidewinder locked in the 11.25° Angle.

The Saw Guide, FIG. 2 is then attached to the Work Piece Guide FIG. 3 with a knurled edge shoulder bolt. The Angle Brace, FIG. 4 is pop riveted on one end to the Saw Guide FIG. 2 is connected at the desired angel with a knurled edge shoulder bolt to the Work Piece Guide FIG. 3. and the tool is completed and ready for use.

I claim:

1. A crosscut saw guide for guiding a hand-held saw (any cutting device) of the type having a moving blade used for cutting sheet and stock material the crosscut saw guide is composed of two pieces of angular material and one flat piece the angular pieces are known as the saw guide and the work piece guide the flat piece is known as the brace the brace has four holes in it the work piece guide abuts the end of the material the crosscut saw guide is placed on the upper surface of the material the brace is permanently affixed to the crosscut saw guide by moving the brace holes into the hole on the work piece guide depending on which hole of the brace is attached will determine the angle at which to cut the material the angles are 90°, 45°, 22.5°, and 11.25° the saw guide can be adjusted so that it can be used by a right or left handed craftsmen by affixing the saw guide into the hole on either end of the work piece guide.

* * * * *